US008777325B2

(12) United States Patent
Wesselmann et al.

(10) Patent No.: US 8,777,325 B2
(45) Date of Patent: Jul. 15, 2014

(54) METHOD FOR DETERMINING THE POSITION OR SITUATION OF INSTALLATION COMPONENTS IN MINERAL MINING INSTALLATIONS AND MINING INSTALLATION

(75) Inventors: Johannes Wesselmann, Dortmund (DE); Marco Ahler, Mülheim a.d.R. (DE); Campbell Morrison, Corinda (AU)

(73) Assignee: Caterpillar Global Mining Europe GmbH, Lunen (DE)

( * ) Notice: Subject to any disclaimer, the term of this patent is extended or adjusted under 35 U.S.C. 154(b) by 208 days.

(21) Appl. No.: 13/380,426

(22) PCT Filed: Jun. 22, 2010

(86) PCT No.: PCT/IB2010/052833

§ 371 (c)(1), (2), (4) Date: Dec. 22, 2011

(87) PCT Pub. No.: WO2010/150196

PCT Pub. Date: Dec. 29, 2010

(65) Prior Publication Data

US 2012/0091782 A1 Apr. 19, 2012

(30) Foreign Application Priority Data

Jun. 23, 2009 (DE) ..... 10 2009 026 011

(51) Int. Cl.
*E21C 35/08* (2006.01)
*E21D 23/12* (2006.01)

(52) U.S. Cl.
CPC ..... *E21C 35/08* (2013.01); *E21D 23/12* (2013.01)
USPC ..... 299/1.7; 299/95

(58) Field of Classification Search
USPC ..... 299/1.05, 1.4, 1.6, 1.7, 1.9, 10, 95
See application file for complete search history.

(56) References Cited

U.S. PATENT DOCUMENTS 4,179,216 A * 12/1979 Theurer et al. ..... 356/4.01
4,330,154 A 5/1982 Harris
4,884,847 A * 12/1989 Bessinger et al. ..... 299/1.05

(Continued)

FOREIGN PATENT DOCUMENTS

DE 1246647 8/1967
DE 2811214 A1 11/1978

(Continued)

*Primary Examiner* — David Bagnell
*Assistant Examiner* — Michael Goodwin
(74) *Attorney, Agent, or Firm* — Foley & Lardner LLP

(57) ABSTRACT

A method and apparatus for determining the position and/or situation of installation components of a mineral mining installation which has as installation components at least one face conveyor for removing mined material, one shield-type support for keeping a face open, pushing devices for pushing the face conveyor and the shield-type support in active operation, an extracting machine which can be moved along the face conveyor, and a drift conveyor, the position and situation of at least one installation component being determined by a measuring system having a detection unit with measurement sensor and the detection unit decoupled from the movement of the extracting machine, can be or is moved to and fro between two points of the guiding system along at least one installation component at the face such as, e.g. the face conveyor, by a separate guiding system 21; a mining installation relating to the same.

28 Claims, 3 Drawing Sheets

(56) References Cited

U.S. PATENT DOCUMENTS

| | | | | |
|---|---|---|---|---|
| 4,887,935 | A | 12/1989 | Koppers et al. | |
| 6,857,705 | B2 * | 2/2005 | Hainsworth et al. | 299/1.7 |
| 7,516,039 | B2 * | 4/2009 | McKitterick | 702/155 |
| 2003/0052529 | A1 * | 3/2003 | Hakkinen | 299/1.05 |
| 2009/0134692 | A1 | 5/2009 | Hargrave et al. | |

FOREIGN PATENT DOCUMENTS

| | | | |
|---|---|---|---|
| DE | 3743758 | A1 | 7/1989 |
| EP | 1276969 | | 11/2001 |
| GB | 2167924 | A | 6/1986 |
| GB | 2263292 | A | 7/1993 |

* cited by examiner

METHOD FOR DETERMINING THE POSITION OR SITUATION OF INSTALLATION COMPONENTS IN MINERAL MINING INSTALLATIONS AND MINING INSTALLATION

The invention relates to a method for determining the position and/or situation of installation components of a mineral mining installation, particularly of a coal mining installation, which has as installation components at least one face conveyor for removing mined material, one shield-type support for keeping a face open, moving devices for moving the face conveyor and the shield-type support in active operation, an extracting machine which can be moved along the face conveyor, and a drift conveyor, the position and situation of at least one installation component being determined by means of a measuring system comprising a detection unit with measurement sensor. The invention also relates to a mining installation for mining, particularly a coal mining installation, with a face conveyor for removing mined material, with a shield-type support for keeping a face open, with moving devices for moving the face conveyor and the shield-type support in active operation, with a gate conveyor and with an extracting machine as installation components of the mining installation, a measuring system comprising a detection unit with measurement sensor being provided for determining the position and situation of at least one installation component of the mining installation.

BACKGROUND OF THE INVENTION

Modern mines for the underground mining (extracting) of minerals in faces relocate more and more work to the surface. In this includes, above all, the monitoring and also the controlling of the extracting process. Providing for the extracting process with the mining installation to be visualized on the surface and for the extracting process to be optimized requires the precisest possible knowledge of the respective current position of as many installation components as possible such as, in particular, of the face conveyor with a possibly installed machine control system for an extracting machine, of the extracting machine itself and possibly also of the powered support assemblies of a shield-type support by means of which the face and the underground mining space is kept open and pushing of the installation components of the mining installation in the extracting or mining direction becomes possible. Since the position and situation both of the extracting and conveyor machine systems at the face and that of the installation components positioned in the roadways change due to the dynamic process, e.g. during the extracting of coal, a solution has long been sought for measuring and determining the situation of all of these installation components if possible in the three-dimensional space (3D).

From DE 1 246 647 A, a two-dimensional method for aligning a mining installation is known in which, after a certain work progress, the respective situation of the face conveyor is determined by means of a directional gyro which is moved along with the moving conveying element of the face conveyor and records the situation of the conveyor on a course recorder by means of an integrator connected to the directional gyro. Recording of the course by means of the directional gyro only takes place from time to time and the method is intended to progress in such a manner that the directional gyro only records position values when the conveyor is taken into operation. However, it is not explained in DE 1 246 647 A how the course recorder is to be read out and the measured values are to be transmitted to a face control system.

From the generic EP 1 276 969, it is known to move a measuring system with inertial navigation system along with the extracting machine in order to determine the position in the two-dimensional space of the rail guide of the face conveyor and of the extracting machine guided thereon. From the position data recorded by means of the inertial system, in turn, drive signals for moving devices are to be derived in order to be able to control the mining installation and the guide means, respectively, in the 3D space. By means of the inertial navigation system, situation changes referring to an initial or starting point are determined, wherein it is also possible to mathematically determine from the relative movements determined by means of the inertial navigation system absolute coordinates in the 3D space at least when an initial point is known in mine surveyor's terms. The measurement data provided by the inertial navigation system are coupled to the movement of the extracting machine.

SUMMARY OF THE INVENTION

It is an object of the invention to create a measuring system and a method, respectively, for a mining installation, by means of which a high measurement data rate is available and, if possible, convergences can also be detected which are produced by the extracting process and the depth at which underground extracting is operated in most cases so that additional situation changes of the installation components due to convergences can also be detected, visualized and, above all, used for control purposes.

According to the basic concept of the invention, this object and others are achieved in the method in that the detection unit, decoupled from the movement of the extracting machine, is moved to and fro between two points of the guiding system along at least one installation component at the face by means of a separate guiding system. Due to the fact that, according to the invention, a detection unit with a suitable measurement sensor, decoupled from the movement and possibly also the rail means of the extracting machine, is moved to and fro, a much higher and much more selective measurement data rate can be provided than in the prior art. Decoupling the detection unit from the movement and the rail means of the extracting machine makes it possible, in particular, that the detection unit can be moved faster than the extracting machine and, e.g., can also be moved to and fro at high speed between two end points of the guiding system for the detection unit which can coincide with end points of the face conveyor.

The detection unit can also be shot to and fro, if necessary, at or within a guide such as, e.g., a tube or a hose which can consist of the most varied suitable materials and have the most varied suitable cross-sectional geometries. The associated guiding system of a measuring system at the face end can advantageously be arranged on the goaf side along the spill plates of the face conveyor pans at a defined height above the floor and/or at or in the face conveyor such as, e.g. at the bottom plate of the face conveyor. In principle, it is also possible to provide a number of measuring systems at the face end which can also be mounted at different installation components. A measuring system at the face end can also have a guiding system attached or arranged in or at the shield-type support.

According to an advantageous embodiment, the movement of the detection unit can be generated by means of a fluid, particularly by means of compressed air, gas, water, oil or an oil emulsion in a guiding system closed in a pressure-tight manner, particularly a hose or a tube. For this purpose, the guiding system can have at least one or precisely one driving device which is switched between blowing and sucking, or the guiding system has at least two driving devices for the detection unit which in each case generate either a pressure or a suction impulse in order to move the detection unit in the guiding system. The driving energy for moving the detection unit can thus be produced alternately from both sides or unilaterally. As an alternative, the movement can also take place via a mechanical drive in that, e.g., the detection unit is provided with its own drive or is pulled externally, e.g. by means of a cable or a cord. The drive units are preferably arranged at the face end, e.g. at the main drive and/or the auxiliary drive of the face conveyor. However, a number of drive units and guiding systems can also be arranged in parallel behind one another and/or section by section, as a result of which at least one end of the guiding system can also be located somewhere at the face.

Depending on the choice of guiding system, the detection unit can be moved without spin or with a rotation, e.g. about its longitudinal axis. A constant spin of the detection unit can be used for achieving greater stability. The spin can be achieved, e.g. by means of a prefabricated groove in the pipe, the tube or the hose. If this increased stability is not utilized, the spin should be avoided in order to facilitate the calculation of the position. The spin can be eliminated, e.g. by means of a mechanical guide (rail) or by distributing the centre of gravity.

According to an alternative embodiment, the guiding system can have an end point which is moved along with the extracting machine. In the case of this embodiment, in particular, the detection unit can be moved in a hose or a tube as guiding system, which is run on or together with a supply line of the extracting machine. In the case of a roller-type filler as extracting machine, in particular, an additional hose can be run as guiding system within the hawser, in which hose the detection unit is then moved to and fro. Although the end point of the guiding system then corresponds to the current position of the extracting machine, the movement of the detection unit remains decoupled from the movement of the extracting machine, in contrast.

As an alternative, the detection unit can be moved mechanically along the guiding system by means of its own drive or by means of an external drive. The guiding system can then be constructed and run almost arbitrarily.

To determine the situation and position and to achieve situation coordinates by means of which, if necessary, drive signals and correction signals can also be calculated for individual installation components such as, e.g., face support and moving devices, it is particularly advantageous if a measuring device, preferably a permanently attached measuring device, is arranged at the gate conveyor, at a pass-over conveyor or at least one of the drives of the face conveyor, a position and situation change of a installation component, a position and situation change of a starting point for a measuring series with the first measuring system and/or the position and situation of at least one drive of the face conveyor being determined from the measurement data of the measuring device in conjunction with a reference point. It is particularly advantageous if at least a second measuring system, preferably a measuring system with guidance device for at least one second detection unit, is arranged in the roadway or at roadway timbering arranged in the roadway, the convergence in the roadway relative to a reference point being determined preferably by means of the second measuring system. When a first measuring system at the face end and a second measuring system at the roadway end and a measuring device attached, e.g., to one of the drives are present, the distance of at least one installation component at the face or at the roadway from the roadway timbering and/or a position and situation change of a installation component can be determined from the measurement data of the measuring system at the roadway and the measurement data of the measuring device in conjunction with the reference point.

The second measuring system can be placed, e.g. in the roadway on and along the roof or on and along the sides of the roadway support on the floor or but also along the installation components such as, in particular, along the drift conveyor which consists, e.g., of a armoured flexible conveyor or of a belt system, or along a pass-over conveyor, by means of which mined material is transferred from the face conveyor to the drift conveyor, and, like the first measuring system, can have at least one guiding system and a detection unit which can be moved to and fro at or in the guiding system.

The above object(s) is(are) also achieved by a mining installation in which, according to the invention, the measuring system for the detection unit has a separate guiding system by means of which the detection unit, decoupled from the movement of the extracting machine, can be moved to and fro between two points of the guiding system. In a mining installation according to the invention it is also particularly advantageous if, by means of driving devices, the detection unit can be moved faster than the extracting machine.

Both in the method and in the mining installation, the detection unit can have a housing, a wireless transmission device such as a radio transmission device, a voltage supply and/or a processor (CPU) being preferably arranged together with the measurement sensor in the housing. It is particularly advantageous if the detection unit is accommodated in a tightly closed measuring cell as housing and/or if the measurement sensor consists of a 2D/3D position and situation sensor or an inertial navigation system, respectively, which comprises an inertial sensor such as, in particular, a gyroscope or gyroscopic compass.

To move the detection unit, the measuring system can have a guiding system closed in a pressure-tight manner, particularly a hose or a pipe in which the detection unit can be moved to and fro by means of a fluid. The guiding system can have a profiled inner wall, wherein the housing of the detection unit can then also have a profiling adapted to the profiling of the inner wall as positive guidance for the detection unit. The detection unit can be rotated during the movement via a possibly coiled course; as an alternative, any spin can also be prevented by a suitable profiling. A movement of the detection unit free of spin can also be effected via a suitable weight distribution in the housing and/or via the situation of the centre of gravity of the detection unit. According to an advantageous embodiment, within the housing, a rotatable mass can be arranged offset by 90° with respect to the direction of movement of the detection unit.

In particular, the guiding system can have a hose or a pipe to which at least one driving device for directly or preferably indirectly accelerating the measurement sensor in one or in both directions of movement between two points of the guiding system is allocated. As an alternative, the measuring system can have a rail-like guiding system.

In the first measuring system at the face it is particularly advantageous if the associated guiding system is attached to the face conveyor or to the shield-type support. Furthermore, a measuring device, preferably a permanently attached measuring device can be arranged at the gate conveyor, at a pass-over conveyor or at least one of the drives of the face conveyor, wherein a position and situation change of a installation component, a position and situation change of a starting point for a measuring series with the first measuring system and/or the position and situation of at least one drive of the face conveyor can be determined from the measurement data of the measuring device in conjunction with a reference point. It is then particularly advantageous if a second measuring system, preferably a measuring system with guidance device for at least one second detection unit, is arranged in the roadway or at roadway timbering arranged in the roadway. In particular, the convergence in the roadway relative to the reference point can be determined by means of the second measuring system.

Furthermore, advantageously, an evaluating device is provided by means of which the data transmitted from the measurement sensor, the measuring device and/or the detection unit can be recalculated into position data relative to a starting position with respect to a measuring series or to a reference point. At least one starting point, which starts a measuring series with each passing of the detector unit, can be allocated to the guiding system. A situation change of the starting point can be determined by means of the measuring device, in particular. As the initial point for accurately determining the position of all machine-related installation components, a suitable fixed point or reference point, the x, y, z coordinates of which are determined in mine surveyor's terms is assumed at least in the 2D space but preferably in the 3D space. In principle, two measuring methods can mainly be used for determining the space coordinates. In the first measuring method, the detection unit can determine for each point in the 3D space the relative deviation, always referring to the fixed point or reference point, and then calculate the roadway difference. In the second measuring method, the detection unit determines on the basis of the fixed point or reference point the relative deviation for each point in the 3D space, always only with respect to the previous measuring point, and thereupon calculates the roadway difference. To carry out the measuring series, it is particularly advantageous if at least one starting point marking initiates the start and possibly also the end of the measurement. The starting point marking can be, e.g., an end stop of the detection unit which at the same time can also form the fixed point in order to simplify the computing effort. After several measurements which, for redundancy reasons, are made, e.g., per section or trip with the extracting machine, the process of walking the shield-type support and pushing the face conveyor by means of the moving devices takes place.

These and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
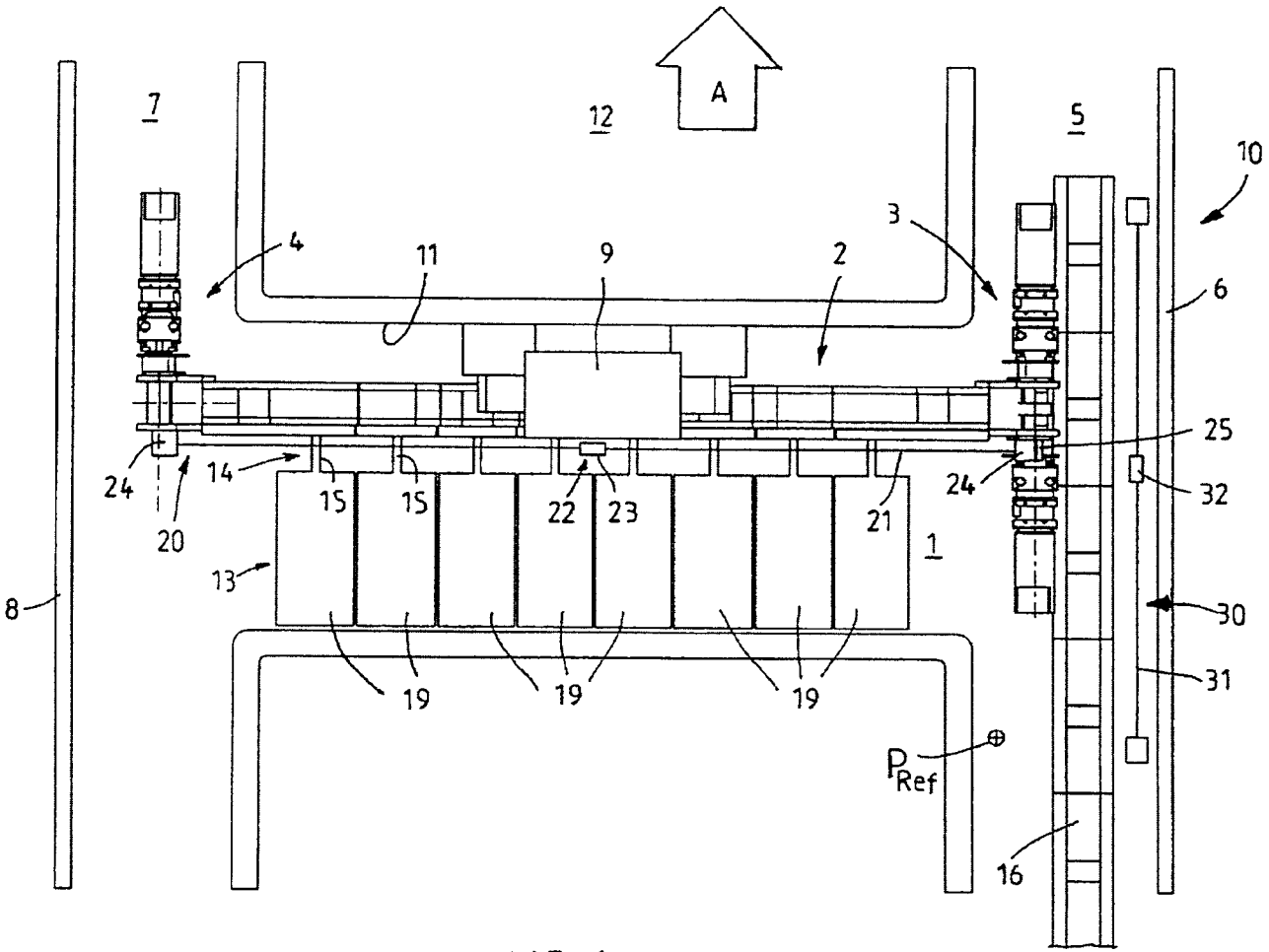
FIG. 1 shows a diagrammatic top view of installation components of a longfront mining installation according to the invention.

Referring now to the drawings wherein the showings are for the purpose of illustrating preferred and alternative embodiments of the invention only and not for the purpose of limiting same, FIG. 1 shows a diagrammatically drawn longfront mining installation is designated by reference symbol 10 overall. Of the installation components of an underground mining installation for mining (working) minerals such as coal in a face designated by reference symbol 11, a face conveyor 2 with a main drive 3 and an auxiliary drive 4, a shearer loader carried at the face conveyor 2 as extracting machine 9, a main roadway 5 with roadway timbering 6 and an auxiliary roadway 7 with associated roadway timbering 8 are indicated.

The extracting machine 9 could be a coal plane, the extracting machine 9 being used for working a coal seam or a location of minerals 12 at a face 11. Material mined with the extracting machine 9 is transported with the face conveyor 2 to the main roadway 5 where it is passed to a pass-over conveyor or a drift conveyor 16 which can then be followed by a belt conveyor system. As is known per se, the face 11 is kept open by means of a shield-type support 13 which has a multiplicity of mutually identical support racks 19. At each support rack 19 of the shield-type support 13, a moving device 14 is supported which can consist of in each case one pushing or walking bar 15 which can be loaded hydraulically in both directions in order to push the face conveyor 2 optionally and section by section in the work direction (arrow A) or pull up individual support racks 19 of the shield-type support 13 in the work direction. The face 11 is kept open by means of the shield caps (roof cap, gob shield) and the surrounding rock can only break in and form the so-called old workings after the advance of the individual support racks 19 as is known to the expert for mining installations in underground mining.

In active operation, the face 11 moves in the direction of arrow A and the installation components of the mining installation 1 such as, in particular, the shield-type support 13, the face conveyor 2 and the drift conveyor 16 must follow this movement or initiate this movement, respectively. Due to external circumstances such as rock bursts, collapse of seam or roadway, wavy course of the seam, due to play in the bearings etc., the situation and position of the individual installation components changes with respect to the precisely straight-line course indicated diagrammatically in FIG. 1 and the current position and situation of as many installation components as possible should be determined as precisely as possible and possibly also displayed above ground. In order to determine the situation and position displacements relatively to a reference point $P_{ref}$ predetermined or measured by mine surveyor techniques, a guiding system 21 for a detection unit 22, which can be moved to and fro along the guiding system 21 preferably within the guiding system 21, of a first measuring system 20 designated by reference symbol 20 on the goaf side is arranged on the whole at the face conveyor 2 in the exemplary embodiment shown, i.e. at the side facing away from the face 11. By means of the detection unit 22 indicated diagrammatically, which in this case has a cylindrical cell-shaped housing 23 within which preferably a gyroscope as measurement sensor, a radio transmission device, a voltage supply and a processor (CPU) are arranged, position and situation changes compared with a previous course or the reference point $P_{ref}$, respectively, can be determined along the current course of the guiding system 21. The detection unit, which can be moved to and fro on a separate guiding system 21, can be moved independently of the extracting machine 9 carried at the face conveyor 2 and, in particular, faster than the latter which is why information relating to the respective current space coordinates can be detected and recorded with an approximately arbitrarily high density and rate. Since the guiding system 21 for the detection unit 22 is attached to the face conveyor or may even be run within the face conveyor 2 or at the face if, e.g., a hose or a tube-shaped duct or the like is used as guiding system, the detection unit 22 at the same time supplies a signal representative of the course of the face in all three spatial directions.

Figure 3:
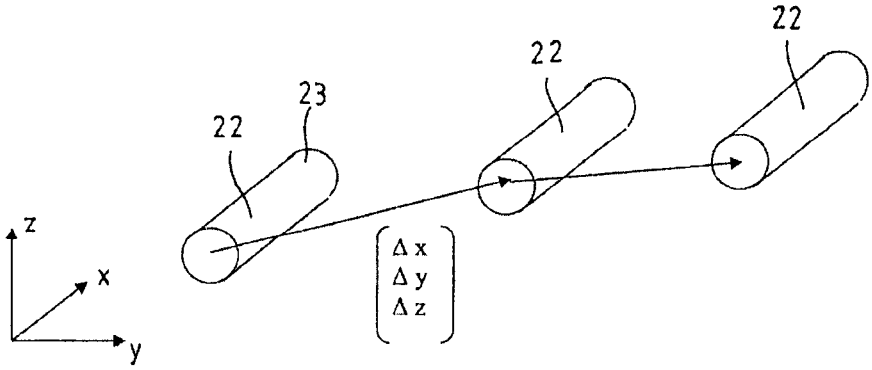
FIG. 3 diagrammatically shows by means of a diagram the distance travelled by a detection unit in the 3D space.

FIG. 3 diagrammatically shows how coordinates for situation changes in the three space directions x, y and z are determined by means of the detection unit 22 at successive measuring points as coordinate group Δx, Δy and Δz. To determine the situation changes or to determine the spatial coordinates in the 3D space, two different measuring and calculating methods can be used, in principle. Either the relative deviation is determined for each point in the 3D space, always relative to the reference point $P_{ref}$, by means of the detection unit 22 as indicated in FIG. 1, and from this a roadway difference Δx, Δy and Δz with respect to reference point $P_{ref}$ is calculated, or the detection units determines on the basis of the reference point $P_{ref}$ the relative deviation for each point in the 3D space, always only with respect to the previous measuring point, and calculates from this the roadway difference. To carry out the measurement, at least one starting point marking should initiate the start and the end of the measurement, wherein the starting point marking can coincide, for example, with the end points of the guiding system or with driving devices 24 for the detection unit 22 as indicated diagrammatically in FIG. 1. After a number of measurements which are made per section for redundancy reasons, the shield-type support 13 is advanced or the face conveyor 2 is pushed, respectively. The degree of advance or pushing, e.g. in the x direction, is obtained from the x coordinates determined in order to achieve the desired face situation. From the y, z coordinates, roof and floor cut data are determined for the extracting machine 9.

Figure 4:
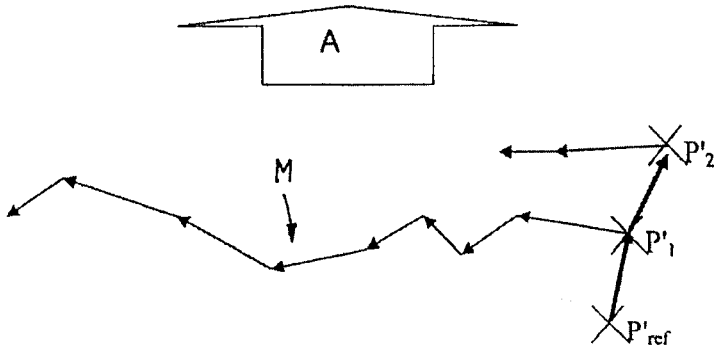
FIG. 4 diagrammatically shows by means of a diagram the change of a starting point, measured by means of a measuring device, for the individual measuring series with the measuring system at the face.

During a pushing process of the face conveyor 2, the main drive 3 and the auxiliary drive 4 are also pushed. With reference to the reference point $P_{ref}$ which, in the best case, can coincide with a previous standing position of the main drive 3, this results in a displacement of the starting point P' for a measuring series M as shown greatly diagrammatically simplified in FIG. 4. After each pushing process of the main drive, the starting point shifts to $P'_1$ after the first moving process and $P'_2$ after the second moving process, and for determining the space coordinates for the respective starting point $P'_1$, $P'_2$, etc., a measuring device 25 which can be preferably permanently installed on the main drive or the associated driving device 24 for the detection unit 22, and may again comprise a gyroscope in order to detect the situation changes relative to the reference point $P_{ref}$, is associated with the main drive. The measuring device 25 can also be a component of a combined measuring and evaluating device in order to calculate from the measurement data of the detection unit 22 and of the measuring device 25 the situation changes relative to the reference point $P_{ref}$. Such a measuring and evaluating device records the relative roadway between the starting points $P'_1$ and $P'_2$ and, together with the data from the moving detection unit 22, can calculate a relative position in the space. If it is assumed that the reference point $P_{ref}$ is defined, i.e. is known in mine surveyor's terms, the other positions can also be determined from the measurement data in absolute coordinates in the space.

To achieve this calculation, further components such as, in particular, a wireless data transmission for communication with the detection unit 22, and computer power and algorithms for calculating the situation of the measuring device 25 and the situation of the detection unit 22 at any time are required. Furthermore, communication with higher-level systems, e.g. a face control system, can be provided. In addition, a starting point marking and possibly a resetting of the detection unit 22 before starting a measuring series should be initiated. The marking and resetting of the measurement sensor of the detection unit are used for minimizing the time-dependent errors due to the increased drift in the case of inexpensive gyroscopic compasses. The marking is used as node for the measuring line and thus as recalibration. The process of recalibration can be repeated an arbitrary number of times.

Figure 2:
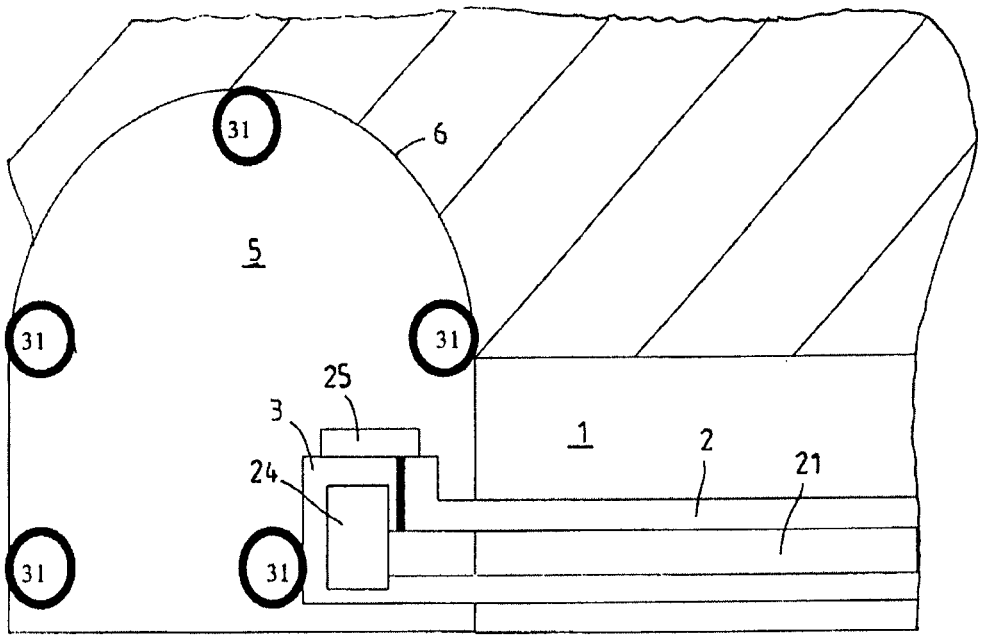
FIG. 2 diagrammatically shows a sectional view of a roadway support if possible assembly positions for a measuring system.

In addition to the first measuring system 20 at the face, a second measuring system 30 at the roadway can be provided at the roadway timbering 6 or, as an alternative, also at the face conveyor which, in turn, can comprise a guiding system 31 and a detection unit 32, which can be moved to and fro along the guiding system 31, as in the first measuring system 20. If the detection unit 32 has a gyroscope as measurement sensor, the detection of convergences can now also be implemented, e.g., in addition to the face situation optimization implemented by means of the first measuring system 20. As is shown diagrammatically in FIG. 2, the guiding system 31 of the second measuring system can be mounted at different positions such as, e.g., at the roof of the roadway timbering 6, at the floor, at the drift conveyor, etc. in order to determine their movement or convergence with time. The system can be used both for face alignment and for floor/roof optimization (enhanced horizon control). By means of the measuring systems and a suitable face control system, drifting of the installation components such as shield-type support, face conveyor etc. can be detected without having to measure the distance in the roadway.

From the measurement data determined by means of the measuring systems 20, 30 and possibly the measuring device 25, and the information calculated therefrom with respect to the course of the face and to the course of the roadway, the face drift Δy can also be calculated in the dip. The relative situation of the measuring device 25 and of the detection unit 22 in the roadway 5 in each case is utilized for determining the distance of the machine frame from the roadway timbering 6, for example, via the reference point. This determination of distance is an indirect measuring method since the distance is calculated trigonometrically. The distance measurement is repeated with time, logged and, as a result, provides information about the roadway convergence (head end drift) and/or about the situation of the face and its installation components and/or of the installation components in the roadway (face drift).

Figure 5:
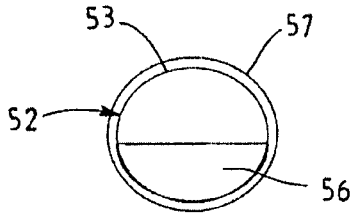
FIG. 5 diagrammatically shows the housing and guiding system of a gravitationally guided detection unit.

FIG. 5 shows in a diagrammatically greatly simplified manner a detection unit 52, which can be moved in a hose 57 as guiding system, with low-lying centre of gravity in order to achieve a movement free of spin and rotation of the detection unit 52 in the round inner space of the hose 57. In the exemplary embodiment shown, almost the entire lower half of the cylindrical cell-shaped housing 53 is filled with a balancing weight 56 whilst the functional components such as gyroscope and inertial sensor, CPU and radio transmission device (not shown) are preferably arranged in the upper housing half. The balancing weight can also be formed by a heavy battery packet or the like.

A movement free of spin could also be achieved with a profiling of the inner wall and an adapted profiling of the housing as positive guidance for the detection unit (not shown). The entire description was done for longfront mining installations in longwall working. The measuring system could also be used with other underground extracting machines and installations such as, in particular, continuous miners in which in most cases neither a shield-type support nor moving devices are used.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A system for determining at least one of the position and situation of installation components of a mineral mining installation, comprising:

one or more installation components, comprising at least one of a face conveyor for removing mined material, a shield support for keeping a face open, a pushing device for pushing the face conveyor and the shield support during active operation, an extracting machine which is movable along the face conveyor, and a gate conveyor;

a measuring system comprising a detection unit with measurement sensor configured to determine the position and situation of the one or more installation components, wherein the detection unit is decoupled from the movement of the extracting machine, and is moved to and fro between two points of a guiding system along the one or more installation components at the face by the guiding system.

2. The system according to claim 1, wherein the detection unit is configured to be moved faster than the extracting machine.

3. The system according to claim 1, wherein the detection unit is configured to be moved by a fluid in the guiding system that is closed in a pressure-tight manner.

4. The system according to claim 3, wherein the guiding system that is closed in a pressure-tight manner includes a hose or tube and the fluid is selected from the group consisting of compressed air, gas, water, oil and an oil emulsion.

5. The system according to claim 3, wherein the guiding system has a driving device which is switched between blowing and sucking.

6. The system according to claim 3, wherein the guiding system has two driving devices which are one of blowing devices and sucking devices.

7. The system according to claim 1, wherein the guiding system has an end point which is moved along with the extracting machine.

8. The system according to claim 1, wherein the detection unit is moved mechanically along the guiding system by a detection drive.

9. The system according to claim 1, wherein a measuring device is arranged proximate at least at one of the gate conveyor, a pass-over conveyor, at least one drive of the face conveyor, so that at least one of: a position and situation change of an installation component, a position and situation change of a starting point for a measuring series with the measuring system and the position and situation of at least one drive of the face conveyor, can be determined from measurement data of the measuring device in conjunction with a reference point.

10. The system according to claim 9, wherein the measuring system comprises a first measuring system, the system further including a second measuring system for at least one second detection unit, wherein the second measuring system is arranged in a roadway or at roadway timbering arranged in the roadway, so that a convergence in the roadway can be determined by the second measuring system.

11. The system according to claim 10, wherein a distance of at least one installation component at the face or at the roadway from the roadway timbering and a position and situation change of another installation component is determined from measurement data of the second measuring system at the roadway and the measurement data of the measuring device in conjunction with the reference point.

12. The system according to claim 10, further including an evaluating device, the evaluating device being configured to receive data from at least one of the detection unit of the first measuring system, the measuring device and the second detection unit of the second measuring system; recalculating the data received by the evaluating device into position data relative to a starting position with respect to at least one of a measuring series and the reference point.

13. The system according to claim 9, wherein the measuring device is configured to determine a situation change of the starting point by way of the measuring device.

14. The system according to claim 1, wherein a starting point, which starts a measuring series with each passing of the detection unit, is allocated to the guiding system of the measuring system.

15. A mining installation for mining, comprising:

at least one installation component comprising at least one of:

a face conveyor operable for removing mined material;

a shield support operable for keeping a face open;

pushing devices for pushing the face conveyor and the shield support in active operation;

a gate conveyor; and an extracting machine;

a measuring system comprising a detection unit with a measurement sensor configured for determining the position and situation of the at least one installation component, the measuring system having a guiding system by way of which the detection unit, decoupled from the movement of the extracting machine, can be moved to and fro between two points of the guiding system.

16. The mining installation according to claim 15, wherein the detection unit can be moved faster than the extracting machine.

17. The mining installation according to claim 15, wherein the detection unit comprises a housing.

18. The mining installation according to claim 17, wherein the detection unit is accommodated in a tightly closed measuring cell housing and the measurement sensor including at least one of a 2D/3D position and situation sensor, an inertial navigation system, an inertial sensor and a gyroscope.

19. The mining installation according to claim 17, wherein a weight distribution in the housing of the detection unit effects a nonrotating movement of the detection unit in the guiding system.

20. The mining installation according to claim 17, wherein within the housing, a rotatable mass is arranged offset by 90° with respect to the direction of movement of the detection unit.

21. The mining installation according to claim 15, wherein the guiding system is closed in a pressure-tight manner, including at least one of a hose and a pipe in which the detection unit can be moved to and fro by a fluid.

22. The mining installation according to claim 21, wherein the detection unit is accommodated in a tightly closed measuring cell housing, as positive guidance for the detection unit.

23. The mining installation according to claim 15, wherein the guiding system includes one of a hose and a pipe to which at least one driving device for accelerating the detection unit in one or in both directions of movement between two points of the guiding system is allocated.

24. The mining installation according to claim 15, wherein the guiding system is attached to one of the face conveyor and the shield support.

25. The mining installation according to claim 15, wherein a measuring device is arranged proximate at least one of the gate conveyor, a pass-over conveyor, at least one drive of the face conveyor, wherein a position and situation change of at least one of an installation component, a starting point for a measuring series with the first measuring system, and the at least one drive of the face conveyor can be determined from the measurement data of the measuring device in conjunction with a reference point.

26. The mining installation according to claim 25, wherein a second measuring system is arranged in at least one of a roadway and a roadway timbering arranged in the roadway, wherein a convergence in the roadway can be determined by the second measuring system.

27. The mining installation according to claim 26, further including an evaluating device, the evaluating device being configured to receive data from at least one of the detection unit of the first measuring system, the measuring device and a detection unit of the second measuring system, the evaluating device configured to recalculate the data into position data relative to a starting position with respect to a measuring series or to a reference point.

28. A method for determining the position of installation components of a mineral mining installation, the method comprising the steps of:

providing at least one installation component selected from the group consisting of a face conveyor for removing mined material, a shield support for keeping a face open, a pushing device for pushing the face conveyor and the shield support during active operation, an extracting machine which is movable along the face conveyor and a gate conveyor;

determining at least one of the position and the situation of the at least one installation component by a measuring system including a detection unit with measurement sensor, the detection unit being decoupled from the movement of the extracting machine and is moved to and fro between two points by a guiding system along at least one installation component at the face by the guiding system.

* * * * *

UNITED STATES PATENT AND TRADEMARK OFFICE

CERTIFICATE OF CORRECTION

PATENT NO. : 8,777,325 B2
APPLICATION NO. : 13/380426
DATED : July 15, 2014
INVENTOR(S) : Wesselmann et al.

It is certified that error appears in the above-identified patent and that said Letters Patent is hereby corrected as shown below:

In the Specification

Column 3, lines 53-54, delete “at least” and insert -- at at least --.

Column 4, line 66, delete “at least” and insert -- at at least --.

Signed and Sealed this
Eighth Day of September, 2015

Michelle K. Lee

Michelle K. Lee
*Director of the United States Patent and Trademark Office*